US010477991B1

(12) United States Patent
Fragala

(10) Patent No.: US 10,477,991 B1
(45) Date of Patent: Nov. 19, 2019

(54) ACCESSORY ORGANIZING AND STORAGE APPARATUS

(71) Applicant: Cajetan J. Fragala, Cortlandt Manor, NY (US)

(72) Inventor: Cajetan J. Fragala, Cortlandt Manor, NY (US)

( * ) Notice: Subject to any disclaimer, the term of this patent is extended or adjusted under 35 U.S.C. 154(b) by 0 days.

(21) Appl. No.: 16/049,960

(22) Filed: Jul. 31, 2018

(51) Int. Cl.
*A47F 7/02* (2006.01)
*A47F 7/03* (2006.01)
*A45C 11/16* (2006.01)

(52) U.S. Cl.
CPC ..... *A47F 7/03* (2013.01); *A45C 11/16* (2013.01); *A47F 7/02* (2013.01); *A47F 7/022* (2013.01)

(58) Field of Classification Search
CPC .... A47F 7/022; A47F 7/02; A47F 7/03; A47F 7/021; A47F 7/0243; A47F 3/10; A47F 3/08; A47F 5/0807; A45C 11/16; A45C 13/02; A45C 11/26; A45C 5/065; A47B 88/42; A47B 2210/0062; A47B 67/02; A47B 81/00; A47B 49/00; A47B 67/00; A47B 67/04; A47B 46/00; A47B 67/005
USPC ..... 206/566, 6.1, 486; 220/532, 533; 211/85.2
See application file for complete search history.

(56) References Cited

U.S. PATENT DOCUMENTS 170,076 A 11/1875 Geldreich
2,254,431 A * 9/1941 Levine ..... A47B 67/02 206/364
2,758,904 A * 8/1956 Hansell ..... A47B 88/42 312/311
3,190,712 A * 6/1965 Fielden ..... A47B 81/00 312/311
3,200,983 A * 8/1965 Walter ..... A47B 88/90 220/533
3,321,117 A * 5/1967 Hedin ..... D05B 91/14 206/227
3,664,719 A * 5/1972 Berg ..... D05B 91/14 312/185
4,111,341 A * 9/1978 Carrozo ..... A45C 11/00 206/227
4,396,121 A * 8/1983 Lemmon ..... A47F 7/03 206/566
4,621,876 A * 11/1986 Reimer ..... A47B 88/487 312/330.1
(Continued)

*Primary Examiner* — Hiwot E Tefera
(74) *Attorney, Agent, or Firm* — Sanchelima & Associates, P.A.; Christian Sanchelima; Jesus Sanchelima

(57) ABSTRACT

An accessory organizing and storage apparatus to store accessories in an organized array, while providing easy access to the particular accessory such as jewellery or the like. The apparatus comprises a housing with an open front, a plurality of vertical panels slidably mounted in the housing for movement into and out of the housing, and a door being hingedly secured to the housing for closing the open front thereof. Each vertical panel is configured with a plurality of accessory holders for securing different types of accessories. The door further comprises a storage area and a plurality of horizontal panels for holding accessories such as ring. The apparatus is simple in construction, portable, light-weight, user-friendly and economical comparatively to the existing jewellery cases. The apparatus further enables users to locate each jewellery accurately and also avoid the chance of entangling or knotting jewelleries.

3 Claims, 4 Drawing Sheets

(56) References Cited

U.S. PATENT DOCUMENTS

| | | | | | |
|---|---|---|---|---|---|
| 4,741,438 | A * | 5/1988 | Mastronardo | G11B 33/0433 | 206/308.1 |
| 4,776,650 | A * | 10/1988 | Ferenzi | A47B 67/02 | 211/85.2 |
| 4,984,854 | A * | 1/1991 | DeLavallade | A47F 3/08 | 211/1.3 |
| 5,067,617 | A * | 11/1991 | Caldwell | A47F 5/0807 | 206/495 |
| 5,117,971 | A * | 6/1992 | Fisher | A47F 7/03 | 206/486 |
| 5,411,139 | A * | 5/1995 | Victory | A47B 81/00 | 206/493 |
| 5,468,063 | A * | 11/1995 | Simonek | A47B 88/42 | 312/287 |
| 5,590,940 | A * | 1/1997 | Richard | A47B 81/00 | 211/162 |
| 6,375,018 | B1 * | 4/2002 | Clement | A47F 7/02 | 211/85.2 |
| 6,422,383 | B1 | 7/2002 | LaMarca | | |
| 6,926,136 | B1 * | 8/2005 | Lynch-Bass | A45C 11/16 | 206/6.1 |
| 9,723,904 | B1 * | 8/2017 | Taylor | A45C 11/16 | |
| 2005/0093405 | A1 * | 5/2005 | Greiner | A47B 67/02 | 312/321.5 |
| 2007/0164643 | A1 * | 7/2007 | Greiner | A45C 11/16 | 312/227 |
| 2007/0262683 | A1 * | 11/2007 | Creed | A47B 67/00 | 312/290 |
| 2012/0068582 | A1 * | 3/2012 | Elderkin | A47B 67/005 | 312/7.1 |
| 2013/0069510 | A1 * | 3/2013 | Wexler | A47B 67/04 | 312/309 |

* cited by examiner

ACCESSORY ORGANIZING AND STORAGE APPARATUS

BACKGROUND OF THE INVENTION

1. Field of the Invention

The present disclosure relates to an organizing and storage apparatus. More specifically, the present disclosure relates to an accessory organizing and storage apparatus that allows a user to store a plurality of accessories such as jewelleries in an organized array therein, for ready access and use.

2. Description of the Related Art

In today's society, it is quite normal for an individual to have a large number of jewellery items such as, rings, earrings, bracelets and the like. Typically, said jewellery items were simply thrown or placed loosely within a jewellery cases or boxes. A problem with storing earrings or other jewellery is that they have a tendency to be misplaced or lost, as well as being scratched or chipped. Further, they are also easily tends to be entangled with other pieces of jewellery. To solve this issue, multiple individual compartments were provisioned within the existing jewellery cases to store each type of jewellery items. However, still some particular type of jewellery items were tough to be located in the compartments, and often become entangled within itself making its retrieval much more difficult.

Several devices have been designed in the past. None of them, however, include an accessory organizing and storage apparatus that is capable of addressing the foregoing discussed issues.

Applicant believes that a related reference corresponds to US patent application number 20070170076A1 filed by Heidi Saddler describes a jewellery box with removable containers. The Heidi reference teaches a jewellery box comprising a drawer and a plurality of removable containers. The size of a removable container can be chosen to accommodate a particular type of jewellery. Further, the container is lined with a soft or cushioning material, selected and configured to protect a jewellery item. However, locating the jewellery stored in the container of the Heidi reference are difficult as the user need to search through each container. Further, the Heidi reference lacks in providing solution for the entangled or twisted jewellery.

Another related reference is U.S. Pat. No. 6,422,383B1 filed by Edward R. LaMarca for jewellery storage and display closet. The Edward reference teaches a jewellery storage and display device, having a vertically mounted slideable drawer disposed within a housing. The housing contains a light transmitting face panel for viewing the stored jewellery. Attached to the drawer are various brackets for storing a variety of jewellery including hoop and clip earrings, chains or post earrings, cufflinks or pins. However, the Edward reference could be used as a display device at jewellery shops, which lacks in providing solution for organizing and storing personal jewellery items.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide an accessory organizing and storage apparatus to store accessories such as, jewellery or jewellery items, in an organized array, enabling easy access to the accessories for a user.

It is another object of the present invention to provide the apparatus comprising a plurality of vertical panels slidably arranged inside a housing, wherein each vertical panel comprises a plurality of accessory holders for holding accessories.

It is another object of the present invention to provide the apparatus comprising a slide mechanism with a pair of guide rails mounted within the housing for receiving each vertical panel.

It is yet another object of the present invention to provide the apparatus comprising a door being hingedly secured to the housing thereof, wherein the door having a storage area and a plurality of horizontal panel, mounted in the storage area.

It is still yet another object of the present invention to provide the apparatus that solves the issue on entangled or twisted jewellery.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
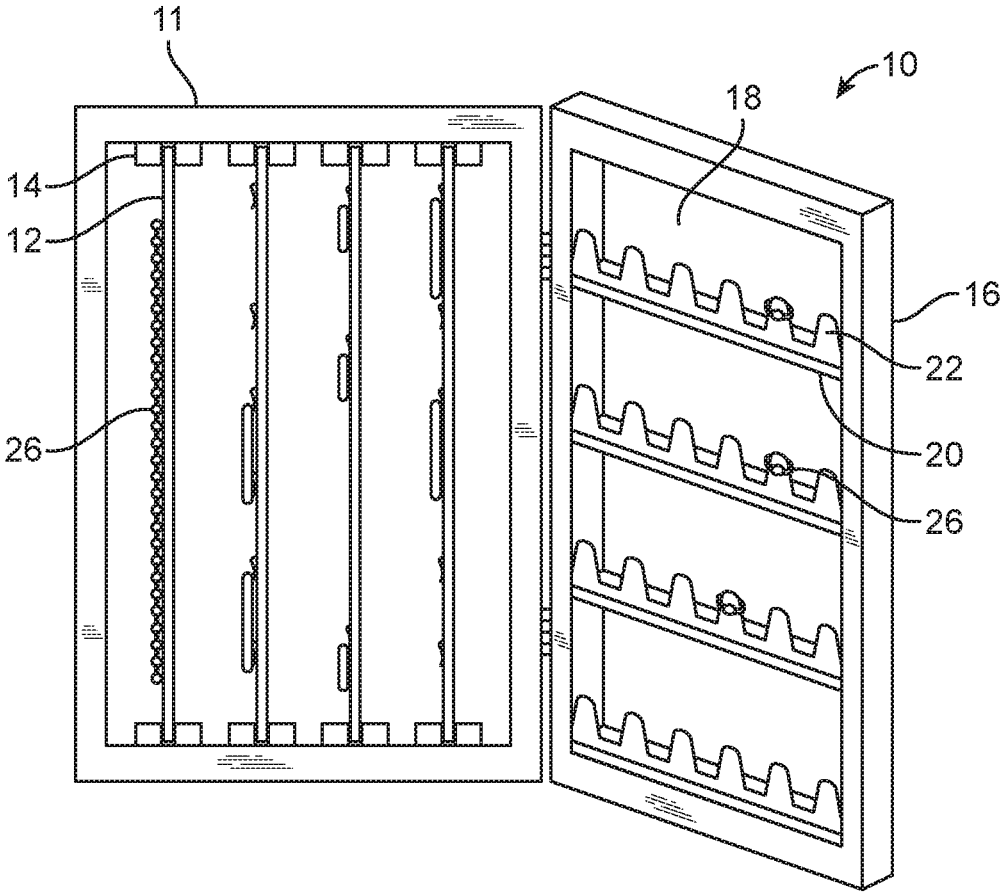
FIG. 1 exemplarily illustrates a front perspective view of an apparatus 10 in opened position, storing accessories such as jewelleries 26 in an organized array, according to an embodiment of the present invention. The apparatus 10 comprising a housing 11 having an open front, a plurality of vertical panels 12 mounted in the housing 11, a pair of guide rails 14, and a door 16 hingedly secured to the housing 11 having a storage area 18 and a plurality of horizontal panel 20 with a ring section 22, is illustrated.
Figure 2:
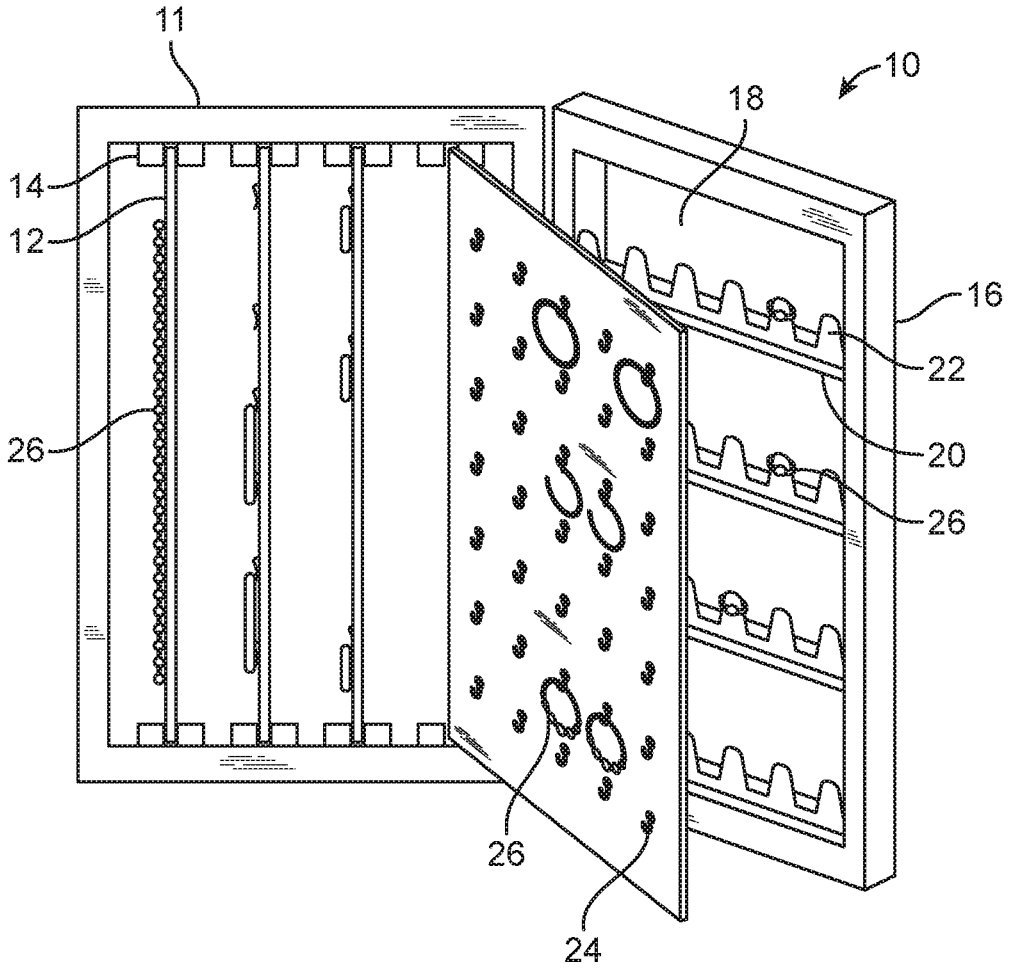
FIG. 2 exemplarily illustrates the vertical panel 12 being moved out of the housing 11 of the apparatus 10, according to an embodiment of the present invention. The vertical panel 12 is slidably mounted in the housing 11 for movement into and out of the housing 11, is illustrated.
Figure 3A:
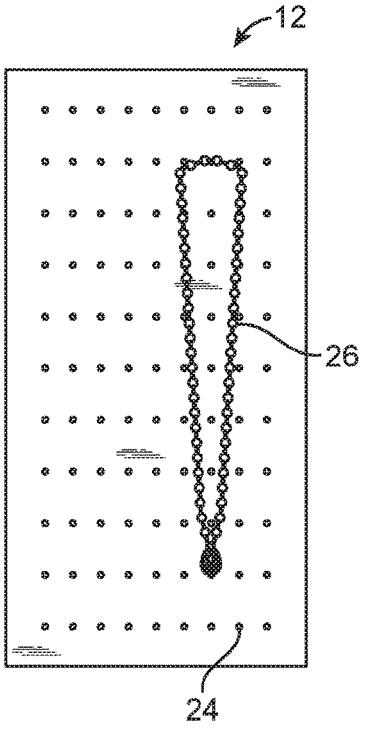
FIG. 3A exemplarily illustrates a vertical panel 12 of the apparatus 10 with a plurality of accessory holders 24 for securing accessories such as jewelleries 26, according to one embodiment of the present invention.
Figure 3B:
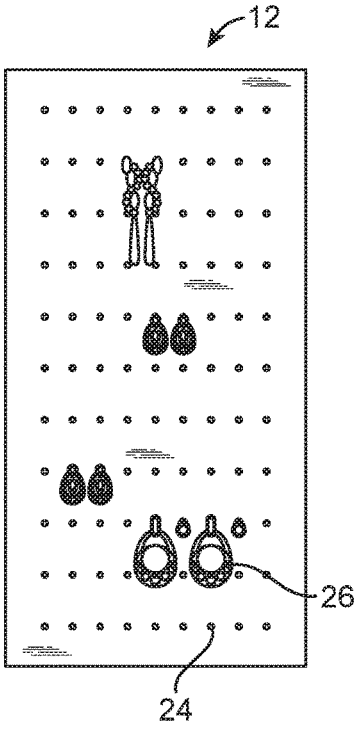
FIG. 3B exemplarily illustrates a vertical panel 12 of the apparatus 10 with a plurality of accessory holders 24 for securing accessories such as jewelleries 26, according to another embodiment of the present invention.
Figure 3C:
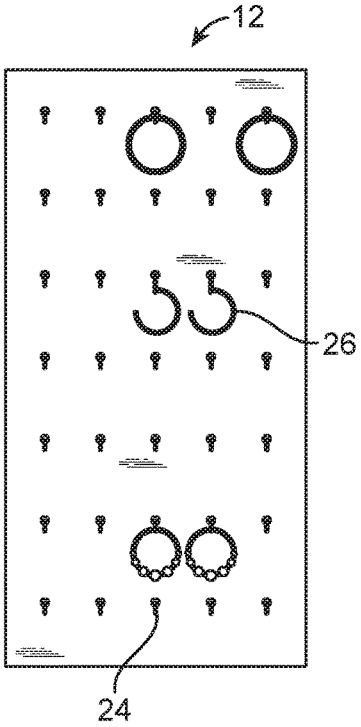
FIG. 3C exemplarily illustrates a vertical panel 12 of the apparatus 10 with a plurality of accessory holders 24 for securing accessories such as jewelleries 26, according to another embodiment of the present invention.
Figure 4:
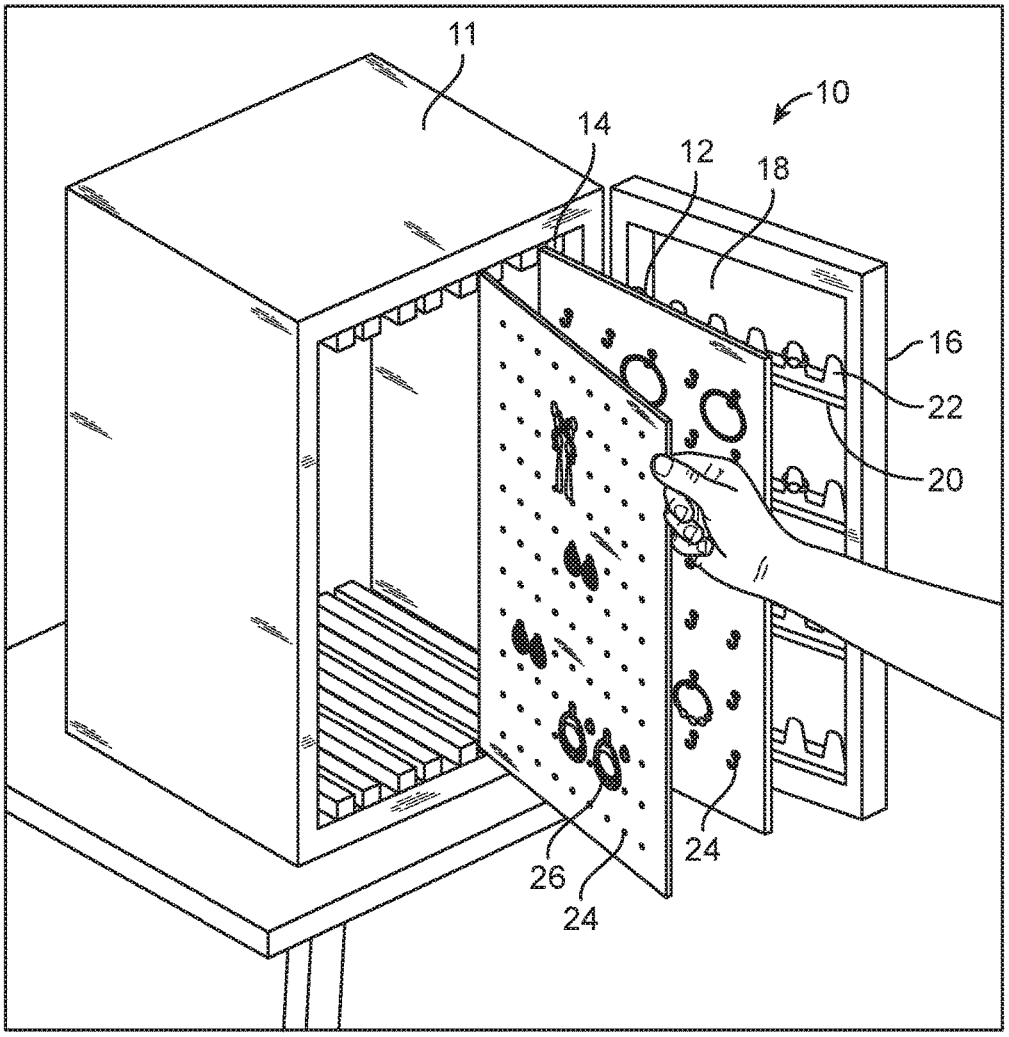
FIG. 4 exemplarily illustrates removable vertical panel 12 from the apparatus 10 by a user, according to an embodiment of the present invention. The plurality of accessory holders 24 attached to each vertical panel 12 for holding accessories, and the ring section 22 attached to each horizontal panel 20 in the door 16 for holding accessories such as ring, is illustrated.

Referring now to the drawings, FIGS. 1-4, where the present invention is generally referred with numeral 10, it can be observed that an apparatus 10 adapted to store accessories such as jewelleries 26 in an organized array, is disclosed. The apparatus 10 of the invention includes a housing 11, a plurality of vertical panels 12 having a plurality of accessory holders 24, and a door 16 hingedly secured to the housing 11.

In an embodiment, the housing 11 is a substantially box-like construction defining a cavity for securing multiple vertical panels 12. The vertical panels 12 are mounted such that they could be slidably moved into and out of the housing 11. The method of mounting the vertical panels 12 may vary, but one preferred method could be enabled by providing a pair of guide rails 14 opposingly faced within the housing 11. The pair of guide rails 14 extends along the length of the inner side of the housing 11 to slidably receive at least one vertical panel 12.

In one embodiment, the plurality of accessory holders 24 in the vertical panel 12 is used for holding different types of accessories. In one embodiment, the accessory holder 24 comprises pegs. In another embodiment, the accessory holder 24 comprises hooks. In another embodiment, the accessory holder 24 comprises holes, where the hook of the jewellery 26 could be secured. In one embodiment, the vertical panel 12 is configured to removably placed in the housing 11. In various embodiments, the jewellery 26 includes different types of jewellery items, but not limited to, brooches, necklaces, ear-rings, rings, pendants, and bracelets.

In one embodiment, the door 16 comprises a storage area 18 and a plurality of horizontal panel 20 mounted in the storage area 18. The horizontal panel 20 comprises a ring section 22 for holding accessory such as ring. The ring section 22 is preferably comprises protrusions made of soft, foam-like material. The protrusion is configured to accommodate ring, so that they could be mounted therein.

In one embodiment, the apparatus 10 is rectangular in shape. In another embodiment, the apparatus 10 could be constructed in any geometrical arrangement that provides an ease of access to the various shape and size of accessories. In another embodiment, the apparatus 10 could be manufactured in different shapes. In one embodiment, the apparatus 10 could be made of wood, plastic, glass, fibrous material, metal or composite material. In one embodiment, the accessory holder 24 is made of steel or aluminum material. In one embodiment, the apparatus 10 could be free standing, mounted on a wall or hanging from a hook or other hanging device. In one embodiment, the apparatus 10 is of 16' in height, 10' in length and 9' in width.

Advantageously, the apparatus 10 is simple in construction, portable, light-weight, user-friendly and economical comparatively to the existing jewellery cases. The apparatus 10 is designed to store each jewelry 26 such as necklaces, bracelets and earrings separately on removable up-right or vertical panels, which solves the problem on entangling or knotting jewelleries. The apparatus 10 further enables users to locate each jewelry 26 accurately. The apparatus 10 further provides the storage area 18 to store rings 22. The apparatus 10 could be displayed on a dresser. Moreover, the removable vertical panel 12 enables the user to view all their jewelry at a glance instead of searching in a pile. In an alternate embodiment, a lock can be included on a side wall of the housing. Also, there can be hooks on the front or back of the panels to accommodate for additional storage. Also, there can be feet having pads on the bottom of the housing to prevent scratching Any furniture.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An accessory organizing and storage apparatus, comprising:

a housing having a top inner surface and a bottom inner surface, said housing includes a front opening that is covered by one door;

said door includes an inner door surface having a width, a front edge and a rear side, said inner door surface extending rearwardly a predetermined amount from said front edge;

at least one horizontal panel mounted along the width of said inner door surface, said at least one horizonal panel mounted perpendicularly to said door within said inner door surface, said at least one horizontal panel protruding from said rear side towards said front edge until said at least horizontal panel is flush with said front edge, said at least one horizontal panel defining a storage space thereon, said at least one horizontal panel having a ring holding assembly mounted thereon, said ring holding assembly being mounted entirely above said at least one horizontal panel, said ring holding assembly including an elongated base with extension members rising entirely from said base, said extension members being interconnected to said base, said elongated base and said extension members being flush with said front edge, said extension members tapering upwardly, said extension members configured to receive and hold at least one ring, said storage space extending therebetween said ring holding assembly and said rear side of said inner door surface, said storage space being able to hold additional accessories thereon, said extension members remain within a periphery of said inner door surface;

said top inner surface includes at least one top pair of guiding blocks rigidly and immovably mounted there and said bottom inner surface includes at least one bottom pair of guiding blocks rigidly and immovably mounted thereon, said at least one top and bottom pair of guiding blocks longitudinally extending entirely along said top inner surface and said bottom inner surface, respectively;

a top channel runs between said at least one top pair of guiding blocks, a bottom channel runs between said at least one bottom pair of guiding blocks, said top channel has a depth extending from said top inner surface a predetermined distance corresponding to a height of said at least one top pair of guiding blocks, said bottom channel has a depth extending from said bottom inner surface a predetermined distance corresponding to a height of said at least one bottom pair of guiding blocks;

at least one vertical panel that includes a front face and a rear face, said front and rear face include a top end that is held between said at least one top pair of guiding blocks and inserted entirely within the depth of said top channel, said front and rear face include a bottom end that is held between said at least one bottom pair of guiding blocks and inserted entirely within the depth of said bottom channel;

a plurality of accessory holders mounted on said at least one vertical panel; and said one door covers the at least one vertical panel in a closed position.

2. The storage apparatus of claim 1 wherein said housing is made of wood, plastic, glass, aluminum, or metal.

3. The storage apparatus of claim 1, wherein the accessories are selected from a group of jewelleries comprising any one or combination of brooches, necklaces, ear-rings, rings, pendants, and bracelets.

* * * * *